US010450666B2

(12) United States Patent
Yoshioka et al.

(10) Patent No.: US 10,450,666 B2
(45) Date of Patent: Oct. 22, 2019

(54) COPPER PLATING SOLUTION AND COPPER PLATING METHOD

(71) Applicant: C. UYEMURA & CO., LTD., Osaka-shi (JP)

(72) Inventors: Yuko Yoshioka, Osaka (JP); Tomoharu Nakayama, Osaka (JP); Hisamitsu Yamamoto, Osaka (JP)

(73) Assignee: C. Uyemura & Co., Ltd., Osaka (JP)

( * ) Notice: Subject to any disclaimer, the term of this patent is extended or adjusted under 35 U.S.C. 154(b) by 59 days.

(21) Appl. No.: 15/464,175

(22) Filed: Mar. 20, 2017

(65) Prior Publication Data

US 2017/0268119 A1 Sep. 21, 2017

(30) Foreign Application Priority Data

Mar. 18, 2016 (JP) ..... 2016-055858

(51) Int. Cl.

| | |
|---|---|
| ***C25D 3/38*** | (2006.01) |
| ***C25D 5/02*** | (2006.01) |
| ***C25D 5/44*** | (2006.01) |
| ***C23C 18/54*** | (2006.01) |

(52) U.S. Cl.

CPC ..... *C25D 3/38* (2013.01); *C23C 18/54* (2013.01); *C25D 5/022* (2013.01); *C25D 5/44* (2013.01)

(58) Field of Classification Search

CPC ..... C23C 18/54

See application file for complete search history.

(56) References Cited

U.S. PATENT DOCUMENTS

| | | | | |
|---|---|---|---|---|
| 2008/0038451 | A1 | 2/2008 | Poole et al. | |
| 2012/0279389 | A1 * | 11/2012 | Kopchick | F02F 1/10 92/181 R |
| 2013/0295294 | A1 | 11/2013 | Ishizaki et al. | |
| 2014/0242288 | A1 * | 8/2014 | Hashimoto | C23C 18/44 427/443.1 |

FOREIGN PATENT DOCUMENTS

| | | | |
|---|---|---|---|
| JP | 2001-295079 | 10/2001 | |
| JP | 2013-076171 | 4/2013 | |
| JP | 2013-234343 | 11/2013 | |
| WO | WO 2014150482 A1 * | 9/2014 | C25D 3/665 |

* cited by examiner

*Primary Examiner* — Bryan D. Ripa
*Assistant Examiner* — Ho-Sung Chung
(74) *Attorney, Agent, or Firm* — Knobbe, Martens, Olson & Bear, LLP

(57) ABSTRACT

A copper plating solution includes: water-soluble copper salt; ethylenediamine; at least one of EDTA, a substituted derivative of EDTA, an ethylenediamine derivative, or glycine; and at least one of hydantoin or a substituted derivative thereof. The copper plating solution allows an aluminum or aluminum alloy base to be displacement-plated with copper.

4 Claims, No Drawings

COPPER PLATING SOLUTION AND COPPER PLATING METHOD

CROSS-REFERENCE TO RELATED APPLICATION

This application claims priority to Japanese Patent Application No. 2016-055858 filed on Mar. 18, 2016, the entire disclosure of which is incorporated by reference herein.

BACKGROUND

The present disclosure relates to a copper plating solution and a copper plating method.

Plating technologies have been used in almost every field ranging from daily necessities to high tech products. Almost every article, such as metallic articles and plastic articles, can be plated. Among them, an article made of aluminum or an aluminum alloy is very easily oxidized. Even if an oxide film on its surface is removed by immersing the article in acid, another oxide film will be formed again in a subsequent washing process. Thus, if this article were pretreated (activated) by a common technique before plating, the resulting plated layer would be less adhesive. Therefore, in general, aluminum or an aluminum alloy is pretreated with zincate before plating.

A zincate treatment is a zincate conversion process, in which aluminum or an aluminum alloy is immersed in a strong alkaline zinc solution to dissolve an aluminum oxide film, and deposit zinc on the exposed surface of aluminum. An aluminum article treated with zincate one time has large-diameter zinc particles deposited sparsely on its surface. Thus, if a different kind of metal is plated thereon, the adherence of such metal does not improve significantly. Therefore, in general, a double zincate treatment in which the zincate treatment is performed twice is conducted.

SUMMARY

During the zincate treatment, however, the deposition of zinc proceeds locally. In particular, if a thin aluminum or aluminum alloy film is to be plated, it is difficult to obtain a plated zinc layer having a uniform thickness over the entire surface of the film by the zincate treatment. Further, in the double zincate treatment, the zincate treatment is performed twice, which leads to unwanted increase in cost and production time.

In view of the foregoing, it is therefore an object of the present disclosure to provide a copper plating solution which allows a copper layer having good adherence to be plated on a surface of aluminum or an aluminum alloy in an easy and inexpensive manner without performing a zincate treatment.

A copper plating solution of the present disclosure may include: water-soluble copper salt; ethylenediamine; at least one of EDTA, a substituted derivative of EDTA, an ethylenediamine derivative, or glycine; and at least one of hydantoin or a substituted derivative thereof, wherein the copper plating solution may enable an aluminum or aluminum alloy base to be displacement-plated with copper. EDTA stands for ethylenediaminetetraacetic acid. In this configuration, a copper layer having good adherence may be displacement-plated on a surface of an aluminum or aluminum alloy base.

It is recommended that the at least one of EDTA, a substituted derivative of EDTA, an ethylenediamine derivative, or glycine have a molar ratio of 0.3 or more and 1.0 or less with respect to the ethylenediamine. Further, it is recommended that the molar ratio be 0.4 or more and 0.7 or less.

Advantageously, the copper plating solution may further include at least one of hypophosphite or organic salt. Further, it is recommended that the copper plating solution be free from nickel salt, i.e., the at least one of hypophosphite or organic salt do not function as a reducing agent.

A copper plating method according to the present disclosure may include: a pretreatment process of pretreating a surface of an aluminum or aluminum alloy base; and a copper plating process of displacement-plating the aluminum or aluminum alloy base with copper using the above-described copper plating solution after the pretreatment process, wherein the copper plating process is performed on the aluminum or aluminum alloy base which is untreated with zincate.

The pretreatment process may include degreasing, alkali etching, and acid washing.

The copper plating solution of the present disclosure allows a copper layer having good adherence to be displacement-plated uniformly on a surface of an aluminum or aluminum alloy base.

DETAILED DESCRIPTION

To plate copper on aluminum or an aluminum alloy (not by electrolysis), in general, displacement plating is not adopted, but electroless plating using a reducing agent is performed after a zincate treatment (see, e.g., Japanese Unexamined Patent Publications Nos. 2013-076171 and 2013-234343). This is because a displacement-plated layer lacks uniformity and adherence.

Japanese Unexamined Patent Publication No. 2001-295079 discloses a method of coating an aluminum base with copper by displacement plating and electroless plating. However, according to this patent publication, the aluminum base is a thin film of 500 Å in thickness, which disappears when immersed in a plating solution. That is to say, copper is not plated on the surface of the aluminum base. Further, an electroless plating solution is adopted as a plating solution, which is used for both of the displacement plating and the electroless plating. Thus, it is conceivable that strong alkali dissolves aluminum, and a copper layer is hardly formed by the displacement plating. Therefore, it may be impossible to displacement-plate a copper layer having good adherence on the surface of the aluminum base according to the method disclosed by Japanese Unexamined Patent Publication No. 2001-295079.

According to a general method of plating the surface of aluminum or an aluminum alloy with copper, a double zincate treatment is performed first, and then electroless plating is conducted. However, as described above, the double zincate treatment leads to increase in cost and production time. Thus, the present inventors have achieved the present disclosure as a result of researches and studies of a pretreatment alternative to the double zincate treatment.

Embodiments of the present disclosure will be described in detail below. Note that the following description of embodiments is only an example in nature, and is not intended to limit the scope, applications or use of the disclosure.

First Embodiment

A copper plating solution according to a first embodiment contains water-soluble copper salt, ethylenediamine, at least one of EDTA, a substituted derivative of EDTA, an ethylenediamine derivative, or glycine, and at least one of hydantoin or a substituted derivative thereof, and allows an aluminum or aluminum alloy base to be displacement-plated with copper. In this case, copper is displacement-plated on an untreated base which is not treated with zincate. Due to difference in iconicity, aluminum immersed in the copper plating solution of the present embodiment dissolves into the plating solution in the form of aluminum ions, and copper ions deposit on the surface of the aluminum or aluminum alloy base. The copper ions and aluminum ions in the plating solution produce complex salt using ethylenediamine and at least one of EDTA, a substituted derivative of EDTA, an ethylenediamine derivative, or glycine as complexing agents. For the production of stable complex salt, the copper plating solution is advantageously alkaline, and has a pH of 9 or higher. Examples of the substituted derivative of EDTA may include HEDTA and EDTA4Na. Examples of the substituted derivative of hydantoin may include 5,5-dimethyl hydantoin and allantoin.

It is recommended that the at least one of EDTA, a substituted derivative of EDTA, an ethylenediamine derivative, or glycine have a molar ratio of 0.3 or more and 1.0 or less with respect to ethylenediamine. It is further recommended that the molar ratio be 0.4 or more and 0.7 or less because the plated copper layer thus obtained significantly improves in uniformity.

Advantageously, the copper plating solution of the present embodiment may further contain at least one of hypophosphite or organic salt. This is because initial reactivity of copper plating improves, and the displacement-plated copper layer thus obtained becomes dense. Hypophosphite is generally used for electroless copper plating as a reducing agent together with nickel salt. However, the copper plating solution of the present embodiment is free from nickel salt, and thus, hypophosphite does not function as the reducing agent in this embodiment. That is to say, due to the presence of hypophosphite, the copper plating solution is in a reducing atmosphere in which no reduction occurs, but oxidation is prevented. Further, the organic salt is a reducing compound and may serve as an alternative of hypophosphite. Examples of the organic salt may include carboxylate, dicarboxylate, and tricarboxylic acid salt. The absence of nickel salt in the copper plating solution means that nickel salt is not added as an ingredient of the plating solution. Even in a situation where a trace amount of nickel salt is contained as impurities, it can also be said that "the copper plating solution is free from nickel salt." Such a trace amount of nickel salt is insufficient for hypophosphite and organic salt to function as the reducing agents.

A copper plating method of the present embodiment includes a pretreatment process of pretreating a surface of an aluminum or aluminum alloy base, and a copper plating process of displacement-plating the aluminum or aluminum alloy base with copper using the copper plating solution after the pretreatment process. The copper plating process is performed on the aluminum or aluminum alloy base which is untreated with zincate. That is to say, this is a method of directly displacement-plating copper on an aluminum or aluminum alloy base which is untreated with zincate. A zincate treatment is performed at a temperature around room temperature, and finishes in a few seconds to several tens of seconds. Thus, a cooling device is required to prevent the temperature from increasing during the treatment. Further, it is not easy to optimize such a short treatment time at all times. Thus, it is very difficult to control the thickness of a plated zinc layer. On the other hand, if the copper plating solution of the present embodiment is used, plating finishes when aluminum exposed on the surface is fully covered with copper. This facilitates the control of the treatment time, and no cooling device is required.

The pretreatment process may include degreasing, alkali etching, and acid washing. Through the three processes, the surface of the aluminum or aluminum alloy base is cleaned, an oxide film which has been formed on that surface is removed, and another oxide film of an appropriate thickness is formed. The degreasing, the alkali etching, and the acid washing may be performed simultaneously using a single treatment solution, or may be performed separately using different solutions. Well-known agents may be used for the respective processes.

Examples of the present disclosure will be described below.

EXAMPLES

—Pretreatment—

A standard test plate of aluminum (A1050P) was prepared as a base. As a pretreatment, the base was (1) treated with a cleaner/conditioner (degreasing agent) at 40° C. for 5 minutes, (2) etched with alkali at 30° C. for 3 minutes, and (3) washed with acid at 25° C. for a minute.

Experiment Nos. 1-3

In Experiment No. 1, the aluminum base pretreated in the above-described manner was immersed in a copper plating solution containing 25 g/L of ethylenediamine, 100 g/L of ethylenediaminetetraacetic acid tetrasodium salt tetrahydrate (EDTA4Na), 30 g/L of copper (II) sulfate pentahydrate, 0.5 g/L of polyethylene glucol (PEG) #1000, and 0.5 g/L of hydantoin at a pH of 10 and a plating temperature of 40° C. for a plating time of 10 minutes to plate the aluminum base with copper.

The plated copper layer thus obtained was evaluated in terms of adherence and deposition uniformity. The adherence was evaluated by a method specified in JIS H 8504-1999 "methods of adhesion test for metallic coatings." Specifically, a cellophane adhesive tape was adhered to a plated layer, and pulled strongly in a stroke to see whether the layer was peeled off or not (if not peeled off, the layer has high adherence). The deposition uniformity was evaluated by visually checking the plated base to see whether an uncovered portion was left or not (whether copper was deposited uniformly or not).

One of essential characteristics of a plated layer is the adherence. As for the deposition uniformity, an uncovered portion, if found through a visual check, will be covered by increasing the plating time, and finally, the base is entirely plated. However, the adherence cannot be easily improved by merely changing the plating conditions.

The plated layer obtained by Experiment No. 1 showed good adherence. Although the layer was partially thin and the deposition uniformity was low, it is conceivable that the plated layer thus obtained would be practically usable if the conditions, such as the plating time, were adjusted.

Experiment No. 2 was performed under the same conditions as Experiment No. 1 except that 50 g/L of sodium hypophosphite was added to the plating solution used in Experiment No. 1. In Experiment No. 3, a plating solution was prepared in the same manner as Experiment No. 2 except that sodium acetate was added in place of sodium hypophosphite. Table 1 shows the results of the experiments.

TABLE 1

| | Unit | Experiment No. 1 | 2 | 3 |
|---|---|---|---|---|
| Ethylenediamine | g/L | 25 | 25 | 25 |
| Ethylenediaminetetraacetic acid tetrasodium salt tetrahydrate (EDTA4Na) | g/L | 100 | 100 | 100 |
| EDTA4Na/ethylenediamine (molar ratio) | | 0.53 | 0.53 | 0.53 |
| Copper (II) sulfate pentahydrate | g/L | 30 | 30 | 30 |
| Sodium hypophosphite | g/L | — | 50 | — |
| Sodium acetate | g/L | — | — | 50 |
| PEG #1000 | g/L | 0.5 | 0.5 | 0.5 |
| Hydantoin | g/L | 0.5 | 0.5 | 0.5 |
| Plating time | min. | 10 | 10 | 10 |
| Plating temperature | ° C. | 40 | 40 | 40 |
| pH | pH | 10 | 10 | 10 |
| Deposition uniformity | | NG | OK | OK |
| Adherence | | OK | OK | OK |

The plating solution containing sodium hypophosphite or organic salt showed good deposition uniformity as well as good adherence.

Experiments Nos. 4-10

Experiment No. 4 was performed under the same conditions as Experiment No. 2 except that the content of hydantoin in the copper plating solution was reduced to 0.3 g/L. Experiments Nos. 5-10 were performed in the same manner as Experiment No. 4 except that the contents of ethylenediamine and ethylenediaminetetraacetic acid tetrasodium salt tetrahydrate (EDTA4Na) in the copper plating solution were changed to modify the molar ratio between EDTA4Na and ethylenediamine. Table 2 shows the results of the experiments.

TABLE 2

| | Unit | Experiment No. 4 | 5 | 6 | 7 | 8 | 9 | 10 |
|---|---|---|---|---|---|---|---|---|
| Ethylenediamine | g/L | 25 | 20 | 23 | 27 | 29 | 38 | 0 |
| Ethylenediaminetetraacetic acid tetrasodium salt tetrahydrate (EDTA4Na) | g/L | 100 | 145 | 115 | 83 | 72 | 0 | 290 |
| EDTA4Na/ethylenediamine (molar ratio) | | 0.53 | 0.96 | 0.66 | 0.41 | 0.33 | 0 | — |
| Copper (II) sulfate pentahydrate | g/L | 30 | 30 | 30 | 30 | 30 | 30 | 30 |
| Sodium hypophosphite | g/L | 50 | 50 | 50 | 50 | 50 | 50 | 50 |
| PEG #1000 | g/L | 0.5 | 0.5 | 0.5 | 0.5 | 0.5 | 0.5 | 0.5 |
| Hydantoin | g/L | 0.3 | 0.3 | 0.3 | 0.3 | 0.3 | 0.3 | 0.3 |
| Plating time | min. | 10 | 10 | 10 | 10 | 10 | 10 | 10 |
| Plating temperature | ° C. | 40 | 40 | 40 | 40 | 40 | 40 | 40 |
| pH | pH | 10 | 10 | 10 | 10 | 10 | 10 | 10 |
| Deposition uniformity | | OK | NG | OK | OK | NG | OK | NG |
| Adherence | | OK | OK | OK | OK | OK | NG | NG |

When ethylenediamine only (Experiment No. 9), or EDTA4Na only (Experiment No. 10) was used as the complexing agent, the resulting plated layer showed decreased adherence. Experiments Nos. 4-8 showed good adherence, which indicates that good adherence would be obtained if the molar ratio of EDTA4Na/ethylenediamine were 0.3 or more and 1.0 or less. In Experiments Nos. 5 and 8, the deposition uniformity was not good. Thus, it is revealed that good adherence and deposition uniformity can be obtained if the molar ratio of EDTA4Na/ethylenediamine is 0.4 or more and 0.7 or less.

Experiments Nos. 11-16

Experiment No. 11 was performed under the same conditions, using the same plating solution, as Experiment No. 4. Experiments Nos. 12-16 were performed in the same manner as Experiment No. 11 except that EDTA4Na in the copper plating solution was replaced with another complexing agent (chelating agent). Table 3 shows the results of the experiments.

TABLE 3

| | Unit | Experiment No. 11 | 12 | 13 | 14 | 15 | 16 |
|---|---|---|---|---|---|---|---|
| Ethylenediamine | g/L | 25 | 25 | 25 | 25 | 25 | 25 |
| Ethylenediaminetetraacetic acid tetrasodium salt tetrahydrate (EDTA4Na) | g/L | 100 | — | — | — | — | — |

TABLE 3-continued

| | Unit | Experiment No. 11 | 12 | 13 | 14 | 15 | 16 |
|---|---|---|---|---|---|---|---|
| EDTA4Na/ethylenediamine (molar ratio) | | 0.53 | 0.53 | 0.53 | 0.53 | 0.50 | 0.53 |
| Rochelle salt | g/L | — | 62 | — | — | — | — |
| Sodium gluconate | g/L | — | — | 48 | — | — | — |
| Trisodium citrate | g/L | — | — | — | 65 | — | — |
| Ethylenediaminetetraacetic acid | g/L | — | — | — | — | 61 | — |
| Glycine | g/L | — | — | — | — | — | 16.5 |
| Copper (II) sulfate pentahydrate | g/L | 30 | 30 | 30 | 30 | 30 | 30 |
| Sodium hypophosphite | g/L | 50 | 50 | 50 | 50 | 50 | 50 |
| PEG #1000 | g/L | 0.5 | 0.5 | 0.5 | 0.5 | 0.5 | 0.5 |
| Hydantoin | g/L | 0.3 | 0.3 | 0.3 | 0.3 | 0.3 | 0.3 |
| Plating time | min. | 10 | 10 | 10 | 10 | 10 | 10 |
| Plating temperature | ° C. | 40 | 40 | 40 | 40 | 40 | 40 |
| pH | pH | 10 | 10 | 10 | 10 | 10 | 10 |
| Deposition uniformity | | OK | NG | NG | NG | OK | OK |
| Adherence | | OK | NG | NG | NG | OK | OK |

When the complexing agent was changed to an amine-based complexing agent, i.e., a substituted derivative of EDTA, an ethylenediamine derivative, or glycine, the resulting plated layer showed good adherence and deposition uniformity. On the other hand, when the complexing agent was changed to polyvalent organic salt such as Rochelle salt, sodium gluconate, or trisodium citrate, the adherence and deposition uniformity of the resulting plated layer were not good.

Experiments Nos. 17-24

Experiment No. 17 was performed under the same conditions as Experiment No. 4 except that hydantoin was removed from the plating solution. Experiment No. 18 was performed under the same conditions, using the same plating solution, as Experiment No. 4. Experiments Nos. 19-24 were performed in the same manner as Experiment No. 18 except that hydantoin was replaced with another nitrogen-containing organic compound (in particular, a nitrogen-containing heterocyclic compound). Table 4 shows the results of the experiments.

Addition of hydantoin or allantoin (a substituted derivative of hydantoin) contributes to good adherence and deposition uniformity. On the other hand, if hydantoin or a substituted derivative thereof is not added, or another nitrogen-containing organic compound different from hydantoin and a substituted derivative thereof is added, the adherence and deposition uniformity are not good.

OTHER EMBODIMENTS

Embodiments have just been described as examples of the present disclosure. However, the present disclosure is not limited to those exemplary embodiments, but may be combined or substituted with common and well-known technologies. Modifications and alterations which can be made by those skilled in the art fall within the scope of the present disclosure.

A base to be plated may be an aluminum base, or an aluminum alloy base containing 50% or more of aluminum. The ratio of the components contained in the copper plating solution is not limited to the ratios described in Examples. Additives other than those described in Examples may also be added.

TABLE 4

| | Unit | Experiment No. 17 | 18 | 19 | 20 | 21 | 22 | 23 | 24 |
|---|---|---|---|---|---|---|---|---|---|
| Ethylenediamine | g/L | 25 | 25 | 25 | 25 | 25 | 25 | 25 | 26 |
| Ethylenediaminetetraacetic acid tetrasodium salt tetrahydrate (EDTA4Na) | g/L | 100 | 100 | 100 | 100 | 100 | 100 | 100 | 100 |
| EDTA4Na/ethylenediamine (molar ratio) | | 0.53 | 0.53 | 0.53 | 0.53 | 0.53 | 0.53 | 0.53 | 0.53 |
| Copper (II) sulfate pentahydrate | g/L | 30 | 30 | 30 | 30 | 30 | 30 | 30 | 30 |
| Sodium hypophosphite | g/L | 50 | 50 | 50 | 50 | 50 | 50 | 50 | 50 |
| PEG #1000 | g/L | 0.5 | 0.5 | 0.5 | 0.5 | 0.5 | 0.5 | 0.5 | 0.5 |
| Hydantoin | g/L | — | 0.3 | — | — | — | — | — | — |
| Allantoin | g/L | — | — | 1 | — | — | — | — | — |
| 2,2'-dipyridyl | g/L | — | — | — | 0.1 | — | — | — | — |
| o-phenanthroline | g/L | — | — | — | — | 0.1 | — | — | — |
| 2-aminopyridine | g/L | — | — | — | — | — | 0.1 | — | — |
| Caffeine | g/L | — | — | — | — | — | — | 0.1 | — |
| L-methionine | g/L | — | — | — | — | — | — | — | 0.1 |
| Plating time | min. | 10 | 10 | 10 | 10 | 10 | 10 | 10 | 10 |
| Plating temperature | ° C. | 40 | 40 | 40 | 40 | 40 | 40 | 40 | 40 |
| pH | pH | 10 | 10 | 10 | 10 | 10 | 10 | 10 | 10 |
| Deposition uniformity | | NG | OK | OK | NG | NG | NG | NG | NG |
| Adherence | | NG | OK | OK | NG | NG | NG | NG | NG |

The conditions for the copper plating (such as time and temperature) are not particularly limited. Further, there are no particular limitations to the conditions for the pretreatment, and the chemical solutions used.

What is claimed is:

1. A copper plating solution comprising:

water-soluble copper salt;

ethylenediamine;

ethylenediaminetetraacetic acid tetrasodium salt tetrahydrate (EDTA4Na);

at least one of hydantoin or a substituted derivative thereof, and at least one of hypophosphite or organic salt, and wherein:

the copper plating solution allows an aluminum or aluminum alloy base to be displacement-plated with copper, and wherein the EDTA4Na has a molar ratio of 0.4 or more and 0.7 or less with respect to the ethylenediamine.

2. The copper plating solution of claim 1, wherein the copper plating solution is free from nickel salt.

3. A copper plating method comprising:

a pretreatment process of pretreating a surface of an aluminum or aluminum alloy base; and a copper plating process of displacement-plating the aluminum or aluminum alloy base with copper using the copper plating solution of claim 1 after the pretreatment process, wherein the copper plating process is performed on the aluminum or aluminum alloy base which is untreated with zincate.

4. The copper plating method of claim 3, wherein the pretreatment process includes degreasing, alkali etching, and acid washing.

* * * * *